United States Patent [19]

Bradshaw

[11] 4,274,685

[45] Jun. 23, 1981

[54] ENTERTAINMENT CENTER CABINET

[75] Inventor: Bruce E. Bradshaw, Jamestown, N.Y.

[73] Assignee: Jamestown Lounge Company, a Division of Arbor Industries, Inc., Jamestown, N.Y.

[21] Appl. No.: 68,208

[22] Filed: Aug. 20, 1979

[51] Int. Cl.[3] ..... A47B 81/06; A47F 3/10

[52] U.S. Cl. ..... 312/7 TV; 312/12; 312/122; 312/125; 312/322

[58] Field of Search ..... 312/7 R, 7 TV, 12, 13, 312/122, 125, 322, 343

[56] References Cited

U.S. PATENT DOCUMENTS

| | | | |
|---|---|---|---|
| 239,237 | 3/1881 | Forncrook | 312/322 |
| 1,827,934 | 10/1931 | Dawson | 312/320 |
| 2,247,232 | 6/1941 | Goldberg | 312/343 |
| 2,413,922 | 1/1947 | Jensen et al. | 312/7 TV |
| 2,571,903 | 10/1951 | Loewi et al. | 312/7 TV |
| 2,724,629 | 11/1955 | Atchison | 312/322 |
| 2,806,754 | 9/1957 | Abeles et al. | 312/7 TV |
| 3,063,774 | 11/1962 | Silver | 312/322 |
| 3,107,959 | 10/1963 | Maxwell, Jr. | 312/322 |
| 3,184,276 | 5/1965 | Billups | 312/274 |
| 3,467,455 | 9/1969 | Caldemeyer | 312/7 R |
| 3,930,552 | 1/1976 | Kunkle et al. | 312/320 |
| 3,936,106 | 2/1976 | Harper | 312/107 |

FOREIGN PATENT DOCUMENTS

| | | | |
|---|---|---|---|
| 2152414 | 5/1973 | Fed. Rep. of Germany | 312/7 R |

*Primary Examiner*—Victor N. Sakran

*Attorney, Agent, or Firm*—Bean, Kauffman & Bean

[57] ABSTRACT

The present invention relates to an entertainment center cabinet featuring an assembly serving to mount a television receiver or the like such that it may be moved outwardly of the cabinet through a front opening thereof and rotated as desired to permit viewing of the receiver at various angles relative to the cabinet. The assembly is fitted with caster devices to prevent forward tilting of the cabinet when the receiver is withdrawn for viewing purposes and a front rail, which cooperates with a cabinet closure or door, to fully close the front opening of the cabinet when the receiver is stored therewithin.

4 Claims, 4 Drawing Figures

ENTERTAINMENT CENTER CABINET

BACKGROUND OF THE INVENTION

In prior U.S. Pat. No. 3,467,455, there is disclosed an entertainment center cabinet including an assembly serving to mount a television receiver or the like such that it may be moved outwardly of the cabinet through a front opening thereof and rotate as desired to permit viewing of the receiver at various angles relative to the cabinet. A potential drawback of this prior cabinet is that, absent the provision of an extremely heavy cabinet base, the outward movement of the assembly and associated receiver will likely result in forward tilting of and damage to the entire cabinet.

SUMMARY OF THE INVENTION

The present invention relates to an entertainment center cabinet incorporating an improved slide assembly for supporting a television receiver or other desired entertainment unit for movements between inserted storage and extended use or viewing positions without causing the cabinet to become unbalanced, such as might otherwise result in forward tilting thereof.

More specifically, the improved slide assembly of the present invention includes a horizontally disposed base slidably supported by a frame of the cabinet for horizontal movements through a front opening defined by top, bottom and opposite side wall panels of the cabinet frame between an inserted position in which it lies essentially coextensive with a bottom panel of the cabinet frame and a fully extended position in which it is essentially removed from within the confines of the cabinet frame; a base anti-tilt device in the form of floor casters arranged to depend from the base adjacent a front marginal edge thereof; a cabinet front rail arranged to depend from adjacent the front marginal edge of the base for concealing the casters and to cooperate with a cabinet frame mounted closure for closing the front opening when the base is disposed in inserted position; a swivel mechanism carried by the base to upstand centrally thereof; and an entertainment unit supporting shelf supported by the swivel mechanism to reside horizontally above and in essential alignment with the base and for rotational movements about a vertically disposed axis.

An advantage of the present invention is that an entertainment unit may be selectively housed or concealed within a relatively light weight cabinet whose internal dimensions need only slightly exceed those of the entertainment unit or fully withdrawn from within the confines of the cabinet for use or viewing purposes without causing the cabinet to become unbalanced. This improved construction results from the placement of the base of the slide assembly immediately adjacent the bottom panel of the cabinet frame and the utilization of caster devices in cooperation with base mounting slide devices to fully support the base throughout the range of its movements between inserted and extended positions.

A further advantage of the present invention is that the base mounted front rail serves both to conceal the caster devices and cooperate with the cabinet closure to provide the cabinet with any desired frontal appearance when the entertainment unit is not in use. As by way of example, when the cabinet closure is a slide opening door, such as that described hereinafter with reference to a preferred form of the present invention, the cabinet may have the appearance of a chest having solid front and side panels bounded by decorative front and side rails. Alternatively, the surface of the cabinet closure may be suitably contoured, such as to provide the cabinet with the appearance of a chest of drawers.

DRAWINGS

The nature and mode of operation of the present invention will now be more fully described in the following detailed description taken with accompanying drawings wherein.

DETAILED DESCRIPTION

Figure 1:
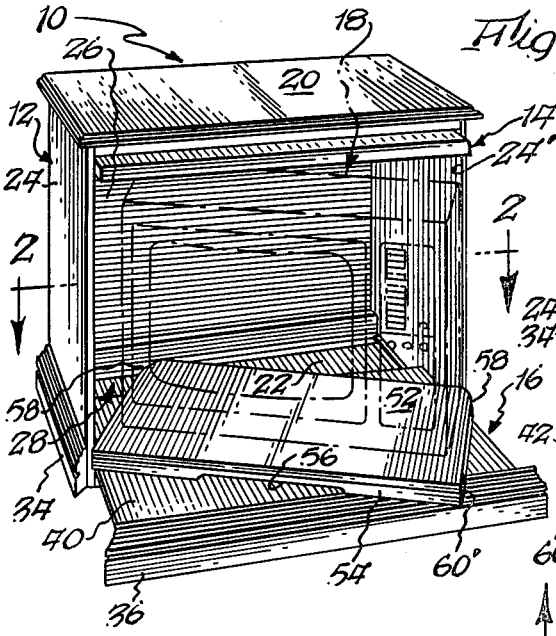
FIG. 1 is a perspective view showing a cabinet formed in accordance with a preferred form of the present invention.

Reference is now made particularly to FIG. 1, wherein an entertainment center cabinet formed in accordance with the present invention is designated as 10 and shown as generally including a cabinet frame or carcass 12, a cabinet closure or door 14 and a slide assembly 16 intended to support a television receiver or other desired entertainment unit 18 in the manner to be described.

Figure 2:
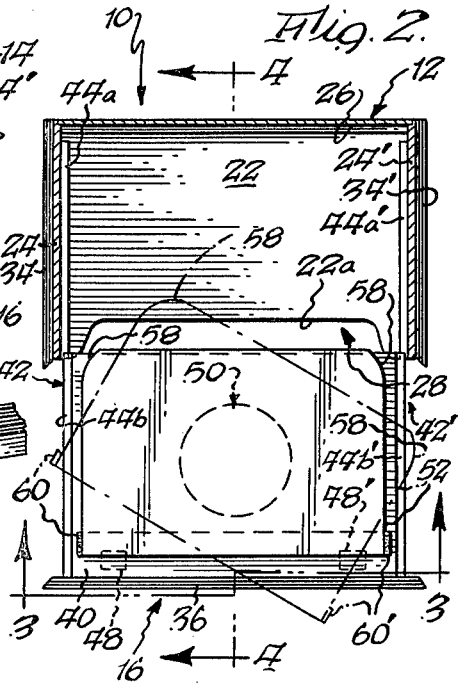
FIG. 2 is a sectional view taken along the line 2—2 in FIG. 1.
Figure 3:
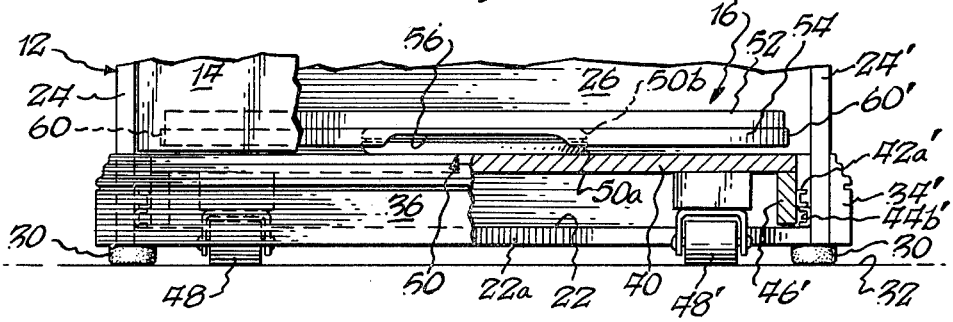
FIG. 3 is a sectional view taken along line 3—3 in FIG. 2.
Figure 4:
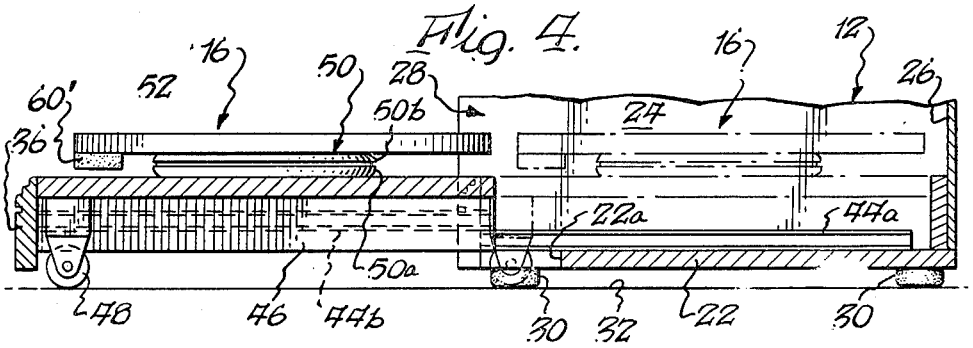
FIG. 4 is a sectional view taken along line 4—4 in FIG. 2.

Cabinet frame 12 is shown in FIGS. 1–4 as including a cabinet top, bottom, opposite side and rear panels 20, 22, 24, 24' and 26, respectively, wherein the top, bottom and opposite side panels cooperate to define a cabinet front opening 28 through which television receiver 18 may be passed between its stored and viewing positions to be described. Bottom panel 22 is shown in FIGS. 2–4 as having its front marginal edge formed with a recess **22*a* and in FIGS. 3 and 4 as being fitted with feet 30 for supporting the cabinet slightly above the surface of a floor 32. Preferably, side panels 24, 24' are fitted with decorative side bottom rails 34, 34' whose forward ends are shaped, as by mitering, to be engaged with like configured ends of a front bottom rail 36 carried by assembly 16** in the manner to be described.

Cabinet door 14 is shown as by way of illustration as being in the form of a single panel, slide opening door, such as may be mounted on cabinet opposite side panels 24, 24' by a conventional pin-slot slide mechanism, not shown, for movement between its cabinet open position shown in FIG. 1 and cabinet closed position partially shown in FIG. 3. Alternatively, if desired, the cabinet door may be formed of plural, hinge mounted panels. In any event, it will be understood that the cabinet door will be sized and mounted such that it permits unimpeded movements of television receiver 18 through cabinet front opening 28 when in its open position and serves to cover only an upper portion of the front opening when in its closed position.

Slide assembly 16 is best shown in FIGS. 2–4 as including a horizontally disposed, rectangular base 40, which is slidably supported by cabinet frame 12 for horizontally directed reciprocating movements through front opening 28 between the inserted position shown in broken line in FIG. 4, wherein it lies essentially coextensive with and adjacent bottom panel 22, and an extended position shown in full line in FIGS. 2 and 4, wherein it is essentially removed from within the confines of cabinet frame 12. It will be noted that front bottom rail 36, which is fixed to depend from adjacent the front marginal edge of base 40, is arranged with its opposite ends in engagement with or close proximity to the front ends of bottom rails 34, 34' when the base is in its inserted position. Also, it will be noted that in the inserted position of base 40, the upper edge of bottom front rail 36 is arranged for engagement with or in close proximity to the lower edge of closure 12 when the latter is in its closed position illustrated in FIG. 3.

A slide mechanism suitable for this purpose may include a pair of conventional drawer type extensive slide devices 42, 42', which include cooperating slide elements 44*a*, 44*a'* and 44*b*, 44*b'* carried respectively by opposite side panels 24, 24' and base attached stiffening rails 46, 46'. The construction of the slide mechanism is not critical to the practice of the present invention, so long as it permits for minimal spacing between base 40 and bottom panel 22 and is adapted to slidably couple the base to the cabinet frame throughout its range of movement. However, a drawer type slide mechanism is preferred in that it serves to constrain the base against side-to-side movements during extensions/retractions thereof and results in a substantially stronger overall cabinet construction.

Assembly 16 additionally includes a base anti-tilt means in the form of a pair of floor surface engaging casters or roller devices 48, 48', which depend from adjacent the front marginal edge of base 40 immediately inwardly of stiffening rails 46, 46'; a conventional swivel mechanism 50, which is located centrally of base 40 and formed with a base affixed or lower part 50*a* and an upper relatively rotatable upper part 50*b*; and a horizontally disposed entertainment unit supporting shelf 52 supported by upper swivel part 50*b* for rotation relative to base 40 about a vertically disposed axis. Shelf 52 is shown as being provided with an additional front rail 54, which depends from adjacent its front marginal edge and is formed with a centrally located and downwardly opening recess 56 sized to receive the fingers of a user for facilitating the pulling of assembly 16 from within the confines of cabinet frame 12. Preferably, the rearwardly disposed corners of shelf 52 are rounded off, as at 58, to permit rotation thereof free of engagement with opposite side panels 24, 24' when base 40 is disposed intermediate its inserted and fully extended position. Damage to the opposite side panels and/or the front corners of the shelf, during such rotation, may be prevented by fixing suitable pumper pads 60, 60' to the ends of rail 54, as best shown in FIGS. 3 and 4.

It will be understood that the construction of the present invention permits the storage of an entertainment unit, such as a television receiver, within a cabinet whose internal dimensions are required to only slightly exceed the dimensions of the unit, due to the relatively small amount of lost or dead space resulting from the placement of base 40 in relatively clost proximity to bottom panel 22. Further, the provision of caster devices 48, 48' adjacent the front edge of base 40 in association with slide devices 42, 42', permits the base and thus the entertainment unit to be fully supported in all positions thereof, so as to avoid the application of any unbalancing force/stress to the cabinet and thus allow the cabinet to be of a relatively light weight construction. Other important aspects of the present invention involve the provision of front rail 36 in association with base 40 and front rail 54 in association with shelf 52. In this respect, front rail 36 cooperates with side rails 34, 34' and with cabinet closure 14 to provide for a unique entertainment cabinet frontal appearance, when the entertainment unit is disposed in its stored condition, as well as serving to at least partially conceal caster devices 48, 48' when slide assembly 16 is extended for use/viewing purposes. Also, as previously noted, front rail 54 is also multi-purpose in function, since it serves to define a convenient hand hold for facilitating extension/retraction of slide assembly 16, to protect the cabinet against damage when shelf 52 is rotated for use/viewing purposes and to at least partially conceal swivel mechanism 50 in all positions of the slide assembly.

While the present invention has been described with particular reference to its use in mounting a television receiver for movement outwardly of a storage cabinet and for rotation to permit viewing thereof at various angles relative to the cabinet, such invention is not limited thereto. In this respect, it is contemplate that the swivel mechanism and shelf may be dispensed with and a suitable entertainment unit or other article to be stored supported directly on the base of the slide assembly.

I claim:

1. A cabinet comprising in combination a cabinet frame, said cabinet frame including in part cabinet top, bottom, opposite side and rear panels, said top, bottom and opposite side panels defining a front opening, said bottom panel having upper and lower horizontally disposed surfaces; a closure sized for removably covering an upper portion of said front opening; and a slide assembly including a horizontally disposed substantially rectangular base slidably supported by said cabinet frame for horizontal movements through said front opening between a cabinet frame inserted position in which it lies essentially coextensive with and adjacent said bottom panel upper surface and a fully extended position in which it is essentially removed from within the confines of said cabinet frame, said base having upper and lower horizontally disposed surfaces, a cabinet front rail depending from and at least coextensive with a front marginal edge of said base and cooperating with said closure to close said front opening when said base is in said inserted position, said front rail vertically extending at least to said bottom panel lower surface when said base is in said inserted position, base anti-tilt means in the form of caster means depending from said base lower surface adjacent said front rail for movement with said base and said front rail to support said base against tilting as the same is moved from its inserted position, whereat said caster means is located horizontally within the confines of said cabinet front opening, to its fully extended position, whereat said caster means is removed from the confines of said cabinet, said front rail having a vertical dimension below said base lower surface of sufficient extent with respect to that of said caster means to substantially hide said caster means from view, a swivel mechanism carried by said base upper surface to upstand centrally thereof and an entertainment unit supporting shelf supported by said swivel mechanism to reside horizontally above and in essential alignment with said base and for rotational movements about a vertically disposed axis.

2. A cabinet according to claim 1, wherein a front marginal edge of said bottom panel is recessed to accommodate said caster means when said base is disposed in said inserted position.

3. A cabinet according to claim 1, wherein said shelf carries another front rail depending from adjacent a front marginal edge thereof and extending into proximity to said base, said other front rail being formed with a recess disposed centrally and opening through a lower marginal edge thereof, and said shelf has its rearwardly disposed corners, as defined by the junctures of its rear marginal edge with its opposite side marginal edges, rounded to permit rotational movements of said shelf free of engagement with said opposite side panels when said base is disposed intermediate said inserted position and said fully extended position.

4. A cabinet according to claim 1, 2 or 3, wherein said first mentioned front rail has opposite ends disposed in overlapping relationship with each of said side panels, and there is further provided cabinet bottom rails fixed to said side panels, each of said bottom rails having forward ends so shaped as to engage said front rail opposite ends when said base is in said inserted position.

* * * * *